US007028361B2

(12) United States Patent
Tsai

(10) Patent No.: US 7,028,361 B2
(45) Date of Patent: Apr. 18, 2006

(54) CLEANING ASSEMBLY

(75) Inventor: Fu-Hsiung Tsai, Taichung (TW)

(73) Assignee: Vanguard International Semiconductor Corporation, Hsinshu (TW)

( * ) Notice: Subject to any disclaimer, the term of this patent is extended or adjusted under 35 U.S.C. 154(b) by 127 days.

(21) Appl. No.: 10/412,344

(22) Filed: Apr. 14, 2003

(65) Prior Publication Data

US 2003/0217422 A1 Nov. 27, 2003

(30) Foreign Application Priority Data

May 21, 2002 (TW) ..... 91207298 U

(51) Int. Cl.
*B08B 9/02* (2006.01)

(52) U.S. Cl. ..... 15/104.05; 15/104.03; 15/3.5; 134/8

(58) Field of Classification Search ..... 15/3.5, 15/104.03, 104.05; 134/8, 22.1, 22.11

See application file for complete search history.

(56) References Cited

U.S. PATENT DOCUMENTS 3,839,085 A * 10/1974 Hulvey et al. ..... 134/8
5,157,802 A * 10/1992 Guidry et al. ..... 15/88
5,626,682 A * 5/1997 Kobari et al. ..... 134/8

FOREIGN PATENT DOCUMENTS

FR 2630934 A * 11/1989
JP 08246175 A * 9/1996
SU 1697913 A1 * 12/1991

* cited by examiner

*Primary Examiner*—John Kim
*Assistant Examiner*—Shay Balsis
(74) *Attorney, Agent, or Firm*—Birch, Stewart, Kolasch & Birch, LLP

(57) ABSTRACT

A cleaning assembly for a pipe. The assembly comprises a sleeve, at least one magnet, and at least one moveable hollow member. The sleeve is moveably disposed on the outer wall of the pipe. The at least one magnet is disposed on the inner surface of the sleeve. The at least one moveable hollow member conforms to the profile of the pipe's interior and is disposed in the interior of the pipe and is metal. When an external force acts on the sleeve along the longitudinal axis of the pipe, the at least one moveable hollow member moves with the sleeve by means of magnetic attraction to clean condensed powder from the pipe.

24 Claims, 2 Drawing Sheets

CLEANING ASSEMBLY

BACKGROUND OF THE INVENTION

1. Field of the Invention

The present invention relates in general to a cleaning assembly. In particular, the present invention relates to a cleaning assembly for a non-magnetic pipe. A moveable hollow member is utilized to move by means of magnetic attraction with a sleeve to clean condensed powder from the pipe.

2. Description of the Prior Art

Some semiconductor process frequently produces a large quantity of powder which accumulates on the inner walls of the piping system. When being cleaned, the piping system is disassembled, and accumulated powder is removed from the inner walls of the piping system by scraping cutters.

The method above is time and labor consuming. The equipment for the semiconductor process must be stopped before disassembling the pipe. Thus, the process is interrupted, and efficiency is reduced.

During cleaning process, the powder floats in the air, and may be inhaled by workers, and some deposits are unpleasant and/or hazardous. Therefore, a vacuum cleaner or dust collecting fan is required to remove the powder or particles.

After being cleaned, the pipe is reassembled, after which successive reconfiguration of the equipment is always required.

The whole cleaning process, including disassembling the pipe, cleaning the pipe, reassembling the pipe, testing the equipment, and letting the equipment settle, requires 5 to 7 hours. The cleaning process must be frequently executed, reducing efficiency and impacting process time. Moreover, the cleaning process can affect worker safety and environment.

SUMMARY OF THE INVENTION

An object of the present invention is to provide a cleaning assembly wherein equipment need not be stopped, and the pipe need not be disassembled. A magnet is utilized in a cleaning assembly. An external force acts on the cleaning assembly along the longitudinal axis of the pipe to be cleaned, and a moveable hollow member moves by means of magnetic attraction to clean condensed powder from the pipe. Thus, the process is more stable and working time of the equipment is increased.

The present invention provides a cleaning assembly for a pipe, comprising a sleeve, at least one magnet, and at least one moveable hollow member. The sleeve is moveably disposed on the outer wall of the pipe. The at least one magnet is disposed on the inner surface of the sleeve. The at least one moveable hollow member conforms to the profile of the pipe's interior and is disposed in the interior of the pipe and is metal. When an external force acts on the sleeve along the longitudinal axis of the pipe, the at least one moveable hollow member moves with the sleeve by means of magnetic attraction to clean condensed powder from the pipe.

The present invention also provides a piping system for semiconductor process, comprising a vacuum chamber, a pump, a pipe, a sleeve, at least one magnet, and at least one moveable hollow member. The pipe is connected to the vacuum and the pump, and is non-magnetic material. The sleeve is moveably disposed on the outer wall of the pipe. The at least one magnet is disposed on the inner surface of the sleeve. The at least one moveable hollow member conforms to the profile of the pipe's interior and is disposed in the interior of the pipe and is metal. When an external force acts on the sleeve along the longitudinal axis of the pipe, the at least one moveable hollow member moves with the sleeve by means of magnetic attraction to clean condensed powder from the pipe.

The present invention also provides an apparatus, comprising a first chamber, a second chamber, a pipe, a sleeve, at least one magnet, and at least one moveable hollow member. The pipe is connected to the first chamber and the second chamber, and is non-magnetic material. The sleeve is moveably disposed on the outer wall of the pipe. The at least one magnet is disposed on the inner surface of the sleeve. The at least one moveable hollow member conforms to the profile of the pipe's interior and is disposed in the interior of the pipe and is metal. When an external force acts on the sleeve along the longitudinal axis of the pipe, the at least one moveable hollow member moves with the sleeve by means of magnetic attraction to clean condensed powder from the pipe.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description the accompanying drawings, which are given by way of illustration only, and thus are not limitative of the present invention, and wherein.

DETAILED DESCRIPTION OF THE INVENTION

Figure 1:
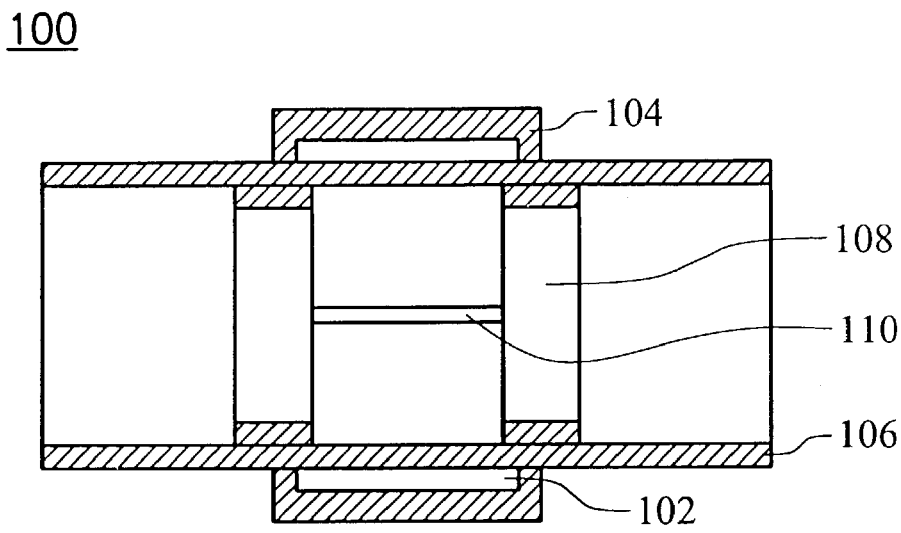
FIG. 1 is a cross-section showing a cleaning assembly of the present invention.

FIG. 1 is a cross-section showing a cleaning assembly of the present invention. The cleaning assembly 100, utilized in a non-magnetic pipe 106, comprises a sleeve 104, at least one magnet 102, a plurality of moveable hollow members 108, and at least one rigid wire 110. The sleeve 104 is moveably disposed on the outer wall of the pipe 106 and is plastic. The at least one magnet 102 is disposed on the inner surface of the sleeve 104. The plurality of moveable hollow members 108 conforms to the profile of the pipe's interior, is disposed in the interior of the pipe 106, and is metal. The at least one rigid wire 110 is respectively connected to the plurality of moveable hollow members 108.

An external force acts on the sleeve 104 along the longitudinal axis of the pipe 106, such that the plurality of moveable hollow members 108 moves with the sleeve 104 by means of magnetic attraction. As the sleeve 104 repeatedly moves in both directions, the plurality of moveable hollow members 108 cleans condensed powder from the pipe 106.

Figure 2:
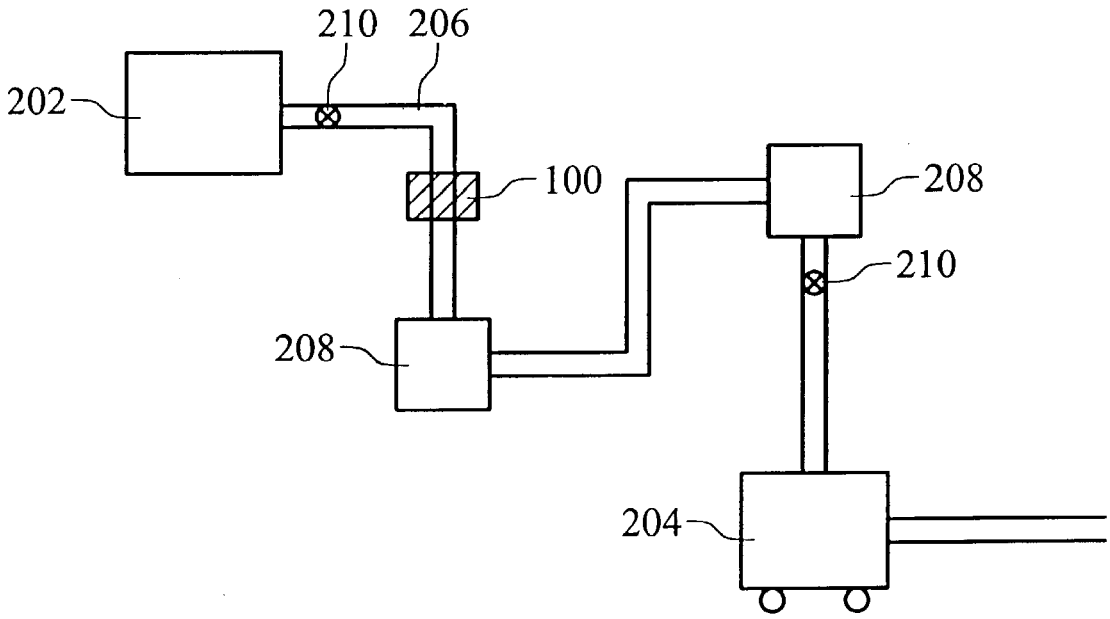
FIG. 2 is a schematic diagram showing a piping system for semiconductor process with the cleaning apparatus of the present invention.

FIG. 2 is a schematic diagram showing a piping system for semiconductor process with the cleaning apparatus of the present invention. The piping system for semiconductor process comprises a vacuum chamber 202, a pump 204, a pipe 206, and a cleaning assembly 100. The pipe 206 is connected to the vacuum chamber 202 and the pump 204, and is non-magnetic material. The piping system for semiconductor process further comprises a plurality of traps 208 between the vacuum chamber 202 and the pump 204.

An external force acts on the cleaning assembly 100 along the longitudinal axis of the pipe 206, and the sleeve 104 moves along the longitudinal axis of the pipe 206. Thus, the plurality of moveable hollow members 108 moves with the sleeve 104 by means of magnetic attraction. As the sleeve 104 repeatedly moves in both directions, the plurality of moveable hollow members 108 cleans condensed powder from the pipe 206.

Moreover, the piping system for semiconductor process further comprises a plurality of valves 210. The plurality of valves 210 is disposed in the pipe 206 to open and close the pipe 206. When the pipe 206 is required to be cleaned, it is only necessary to close the valve 210 before starting the cleaning, eliminating the time required to stop the equipment, disassemble the pipe from the equipment, clean the pipe, reassemble the pipe to the equipment, and season the equipment.

Figure 3:
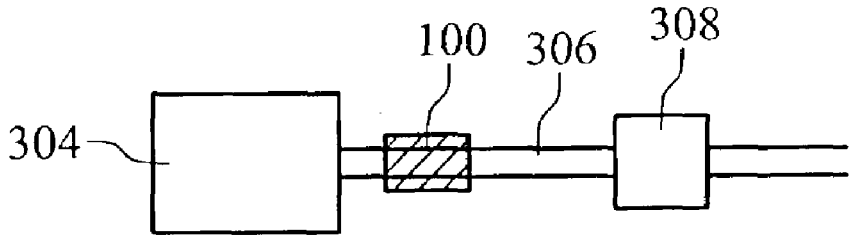
FIG. 3 is another schematic diagram showing a piping system for semiconductor process with the cleaning apparatus of the present invention.

FIG. 3 is a schematic diagram showing a piping system for semiconductor process with the cleaning apparatus of the present invention. The piping system for semiconductor process comprises a pump 304, a trap 308, a pipe 306, and a cleaning assembly 100. The pipe 306 is connected to the outlet of the pump 304 and the trap 308, and is non-magnetic material.

An external force acts on the cleaning assembly 100 along the longitudinal axis of the pipe 306, and the sleeve 104 moves along the longitudinal axis of the pipe 306. Thus, the plurality of moveable hollow members 108 moves with the sleeve 104 by means of magnetic attraction. As the sleeve 104 repeatedly moves in both directions, the plurality of moveable hollow members 108 cleans condensed powder from the pipe 306.

Figure 4:
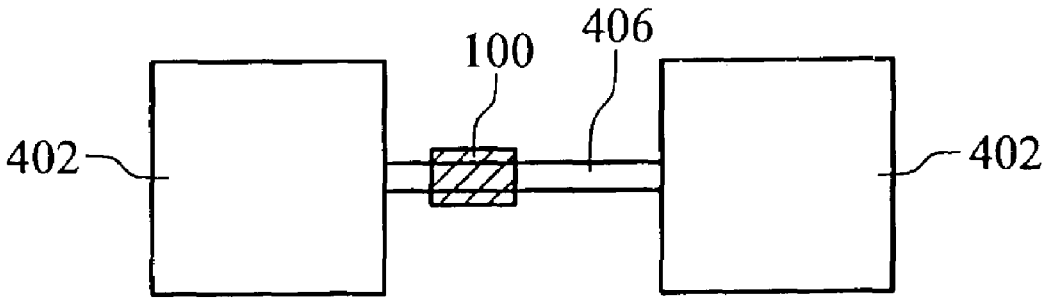
FIG. 4 is a schematic diagram showing an apparatus of the present invention.

FIG. 4 is a schematic diagram showing an apparatus of the present invention. The apparatus comprises two chambers, such as two high temperature chemical chambers 402, a pipe 406, and a cleaning assembly 100. The pipe 406 is connected to the two chambers 402 and is non-magnetic material.

An external force acts on the cleaning assembly 100 along the longitudinal axis of the pipe 406, and the sleeve 104 moves along the longitudinal axis of the pipe 406. Thus, the plurality of moveable hollow members 108 moves with the sleeve 104 by means of magnetic attraction. As the sleeve 104 repeatedly moves in both directions, the plurality of moveable hollow members 108 cleans condensed powder from the pipe 406.

Finally, while the invention has been described by way of example and in terms of the preferred embodiments, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A cleaning assembly for a pipe, comprising:

a sleeve, moveably disposed on an outer wall of the pipe;

at least one magnet, disposed on an inner surface of the sleeve;

a plurality of moveable hollow members, conforming to the profile of a pipe's interior, disposed in the interior of the pipe and are metal; and a connecting element comprising at least one rigid wire respectively connected to the plurality of moveable hollow members, wherein an external force acts on the sleeve along a longitudinal axis of the pipe, and the moveable hollow members move with the sleeve by means of magnetic attraction to clean condensed powder from the pipe.

2. The cleaning assembly for a pipe as claimed in claim 1, wherein the sleeve is plastic.

3. The cleaning assembly for a pipe as claimed in claim 1, wherein the length of the moveable hollow members along the longitudinal axis of the pipe is longer than the sleeve.

4. The cleaning assembly for a pipe as claimed in claim 1, wherein the total length of the plurality of moveable hollow members plus the at least one rigid wire is longer than the sleeve.

5. A piping system for semiconductor process, comprising:

a pipe, of non-magnetic material;

a sleeve, disposed on an outer wall of the pipe;

at least one magnet, disposed on an inner surface of the sleeve;

a plurality of moveable hollow members, conforming to the profile of a pipe's interior, disposed in the interior of the pipe and are metal; and a connecting element comprising at least one rigid wire respectively connected to the plurality of moveable hollow members, wherein an external force acts on the sleeve along a longitudinal axis of the pipe, and the moveable hollow members move with the sleeve by means of magnetic attraction to clean condensed powder from the pipe.

6. The piping system for semiconductor process as claimed in claim 5, wherein the sleeve is made of plastic.

7. The piping system for semiconductor process as claimed in claim 5, wherein the length of the moveable hollow member along the longitudinal axis of the pipe is longer than the sleeve.

8. The piping system for semiconductor process as claimed in claim 5, wherein the total length of the plurality of moveable hollow members plus the at least one rigid wire is longer than the sleeve.

9. The piping system for semiconductor process as claimed in claim 5, further comprising a plurality of valves, disposed in the pipe to open and close the pipe.

10. A piping system for semiconductor process, comprising:

a vacuum chamber;

a pump;

a pipe, connected to the vacuum chamber and the pump, of non-magnetic material;

a sleeve, disposed on the outer wall of the pipe;

a sleeve, disposed on the outer wall of the pipe;

at least one magnet, disposed on the inner surface of the sleeve;

a plurality of moveable hollow members, conforming to the profile of the pipe's interior, disposed in the interior of the pipe and made of metal; and a connecting element comprising at least one rigid wire respectively connected to the plurality of moveable hollow members, wherein an external force acts on the sleeve along the longitudinal axis of the pipe, and the moveable hollow members move with the sleeve by means of magnetic attraction to clean condensed powder from the pipe.

11. The piping system for semiconductor process as claimed in claim 10, wherein the sleeve is plastic.

12. The piping system for semiconductor process as claimed in claim 10, wherein the length of the at least one moveable hollow member along the longitudinal axis of the pipe is longer than the sleeve.

13. The piping system for semiconductor process as claimed in claim 10, wherein the total length of the plurality of moveable hollow members plus the at least one rigid wire is longer than the sleeve.

14. The piping system for semiconductor process as claimed in claim 10, further comprising a plurality of traps between the vacuum chamber and the pump.

15. The piping system for semiconductor process as claimed in claim 10, further comprising a plurality of valves, disposed in the pipe to open and close the pipe.

16. A piping system for semiconductor process, comprising:

a pump;

a trap;

a pipe, connected to the outlet of the pump and the trap, and made of non-magnetic material;

a sleeve, disposed on the outer wall of the pipe;

at least one magnet disposed on the inner surface of the sleeve;

a plurality of moveable hollow members, conforming to the profile of the pipe's interior, disposed in the interior of the pipe and are metal; and a connecting element comprising at least one rigid wire respectively connected to the plurality of moveable hollow members, wherein an external force acts on the sleeve along the longitudinal axis of the pipe, and the moveable hollow members move with the sleeve by means of magnetic attraction to clean condensed powder from the pipe.

17. The piping system for semiconductor process as claimed in claim 16, wherein the sleeve is plastic.

18. The piping system for semiconductor process as claimed in claim 16, wherein the length of the moveable hollow members along the longitudinal axis of the pipe is longer than the sleeve.

19. The piping system for semiconductor process as claimed in claim 16, wherein the total length of the plurality of moveable hollow members plus the at least one rigid wire is longer than the sleeve.

20. An apparatus, comprising:

a first chamber;

a second chamber;

a pipe, connected to the first chamber and the second chamber, made of non-magnetic material;

a sleeve, disposed on the outer wall of the pipe;

at least one magnet, disposed on the inner surface of the sleeve;

a plurality of moveable hollow members, conforming to the profile of the pipe's interior, disposed in the interior of the pipe and are metal; and a connecting element comprising at least one rigid wire respectively connected to the plurality of moveable hollow members, wherein an external force acts on the sleeve along the longitudinal axis of the pipe, and the moveable hollow members move with the sleeve by means of magnetic attraction to clean condensed powder from the pipe.

21. The apparatus as claimed in claim 20, wherein the sleeve is plastic.

22. The apparatus as claimed in claim 20, wherein the length of the moveable hollow member along the longitudinal axis of the pipe is longer than the sleeve.

23. The apparatus as claimed in claim 20, wherein the total length of the plurality of moveable hollow members plus the at least one rigid wire is longer than the sleeve.

24. The apparatus as claimed in claim 20, further comprising a plurality of valves, disposed in the pipe to open and close the pipe.

* * * * *